US005715580A

United States Patent [19]

Johnson, III

[11] Patent Number: 5,715,580

[45] Date of Patent: Feb. 10, 1998

[54] STRAPPING SYSTEM AND FASTENER THEREFOR

[75] Inventor: Walter M. Johnson, III, Tarpon Springs, Fla.

[73] Assignee: NET/WERK/USA, Inc., New York, N.Y.

[21] Appl. No.: 708,840

[22] Filed: Sep. 9, 1996

[51] Int. Cl.[6] ..... A44B 11/00

[52] U.S. Cl. ..... 24/200; 24/197; 24/198

[58] Field of Search ..... 24/200, 199, 198, 24/197

[56] References Cited

U.S. PATENT DOCUMENTS

| | | | |
|---|---|---|---|
| 1,216,881 | 2/1917 | Tabler | 24/200 |
| 1,519,708 | 12/1924 | Tapp . | |
| 1,836,923 | 12/1931 | Hodge . | |
| 2,012,466 | 8/1935 | Goldsmith et al. | 24/198 |
| 2,058,931 | 10/1936 | Williams | 24/200 |
| 2,293,562 | 8/1942 | Rosenthal | 24/200 |
| 2,407,466 | 9/1946 | Alberts | 24/198 |
| 2,977,655 | 4/1961 | Peters . | |
| 2,981,994 | 5/1961 | White | 24/200 |
| 2,982,015 | 5/1961 | Harley | 24/197 |
| 3,678,541 | 7/1972 | Lefkowitz | 24/200 |
| 3,858,279 | 1/1975 | Brattstrom | 24/200 |
| 3,967,347 | 7/1976 | Bickis . | |
| 4,117,573 | 10/1978 | Nakamura | 24/200 |
| 4,299,014 | 11/1981 | Wood . | |
| 4,484,379 | 11/1984 | Appelt et al. | 24/200 |
| 4,525,901 | 7/1985 | Krauss | 24/200 |
| 4,571,783 | 2/1986 | Kasai | 24/200 |
| 5,007,138 | 4/1991 | Pritchhard et al. | 24/200 |
| 5,027,479 | 7/1991 | Scheffczyk . | |
| 5,426,829 | 6/1995 | Hsiung | 24/200 |

FOREIGN PATENT DOCUMENTS

| | | | |
|---|---|---|---|
| 867048 | 9/1941 | France . | |
| 2612033 | 10/1976 | Germany | 24/200 |
| 1227596 | 4/1971 | United Kingdom | 24/197 |

*Primary Examiner*—Victor N. Sakran
*Attorney, Agent, or Firm*—Moonray Kojima

[57] ABSTRACT

A strapping system and buckle therefor comprising a planar frame with a pair of parallel end legs connected by a pair of parallel side legs to define an opening therebetween, and a bridging legl connecting the side legs with an opening between the bridging leg and the two end legs, respectively, of suitable dimensios to thread a strap therethrough with the bridging leg disposed between the threaded strap, and wherein one end leg is extended to hold permanently one end of the strap, the other end being threaded through the buckle. Advantageously, the buckle is of a unitary structure which can be easily and inexpensively manufactured, and utilizes only a single bridging leg having at least a part thereof above the planar frame together with suitable dimensions of the openings between the bridging leg and end legs to lock the strap threaded therethrough.

14 Claims, 1 Drawing Sheet

STRAPPING SYSTEM AND FASTENER THEREFOR

BACKGROUND OF THE INVENTION

1. Field of Invention

This invention relates to a strapping system, and more particularly, to an improved buckle or fastener used therefor.

2. Discussion of the prior Art

The prior art contains many different types of buckles or fasteners for holding together ends of a strap. A partial list of know art is as follows: U.S. Pat. Nos. 3,967,347; 2,977,655; 4,299,014; 5,027,479; 5,426,829; 1,836,923; 1,519,708; and French Patent 867,048.

A copending application to the applicant 08/685,971 non-allowed shows a buckle or fastener comprising a single flat piece disposed between side legs of a frame with an extension for holding one end of a strap. In said copending application SN 08/685,971, there was cited as prior art U.S. Pat. Nos. 4,571,783; 5,426,829; 2,293,562;2,407,466; 3,858,279; 4,525,901; 2,058,931 and German 2,612,033. It was found through experimentation that the buckle did not perform up to par at all times.

Hence, there is still room for improvement in this field.

SUMMARY OF THE INVENTION

Accordingly, an object of the invention is to provide a buckle or fastener which is simple and economical to produce, and can reliably and securely hold together the ends of a strap used to hold an object.

DETAILED DESCRIPTION OF THE PREFERRED EMBODIMENTS

Figure 1:
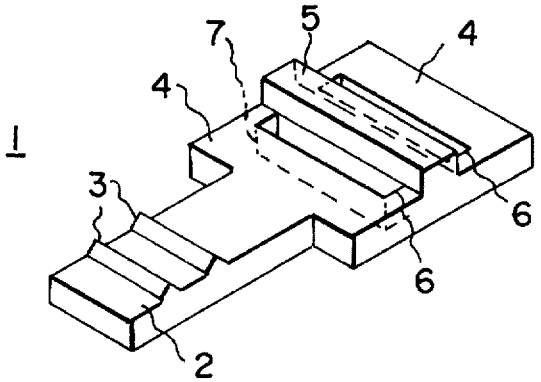
FIG. 1 is a perspective view depicting an illustrative embodiment of the invention.
Figure 2:
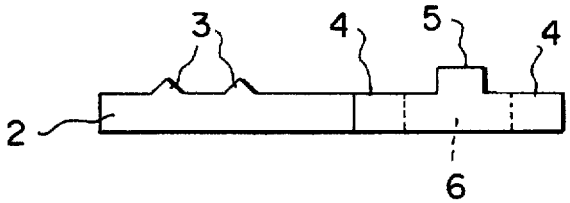
FIG. 2 is a right side elevational view of the embodiment of FIG.1.

FIGS. 1–5 show a strap fastener or buckle 1 comprising an extension part 2 connected to a frame comprising parallel end legs 4,4 connected by parallel side legs 7,7 with an opening 6 defined thereby, and bridging the side legs is bridging leg 5 which is parallel to end legs 4,4. The bridging leg 5, hole 6 and end legs 4,4 and side legs 7,7 are of suitable dimensions so that between bridging legl 5 and end legs 4,4 and side legs 7,7, the holes therebetween will be of dimensions such as to be sufficient for strap 10 (see FIG. 5) can be threaded therethrough. For example, the opening 6 between bridging leg 5 and side legs can be of a width about the width of the strap 10, and be of a thickness dimension about the thickness dimension of the strap 10.

On a top surface of extension part 2 are a plurality of protrusions 3 so that when the end of strap 10 is placed on the top surface of extension part 2 and sonic welded, the weld will be of improved effectiveness. The protrusion 3 can also be a channel or a roughened surface, and instead of sonic welding or bonding, a heat welding can be used, or an adhesive of quick fixing time can be used, to adhere the end of the strap 10 permanently to the extension part 2. The width of part 2 can be as desired, but, in terms of optional use of material, it can be advantageously as small as the width of the strap 10 to be permanently adhered thereto. Also, the width of hole 6 can be about the width of the strap 10.

Advantageously, the entire buckle or fastener can be molded of plastic resin as a unitary structure. In that manner, the buckle 1 can be produced economically and be of unitary structure and be easily handled during production.

Figure 5:
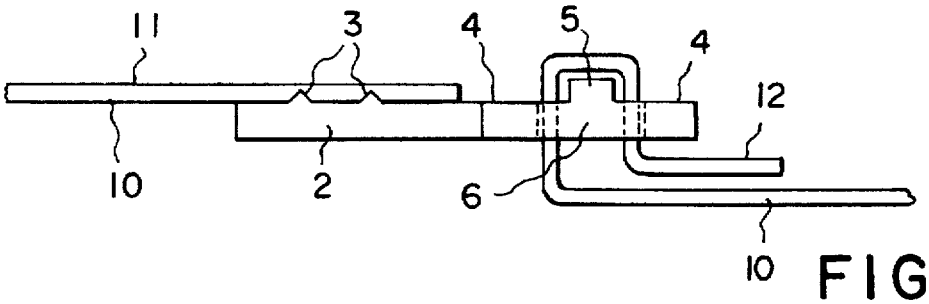
FIG. 5 is a right side elevational view with the strap ends attached thereto.
Figure 3:
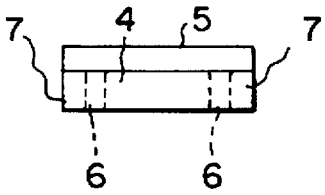
FIG. 3 is a rear elevational view of the embodiment of FIG. 1.
Figure 4:
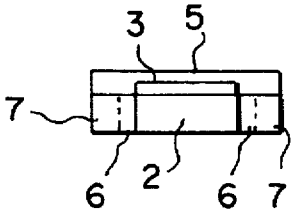
FIG. 4 is a front elevational view of the embodiment of FIG 1.

Turning to FIG. 5, the buckle is part of a strapping system comprising a strap 10 having one end 11 permanently attached to extension part 2, such as by sonic bonding, heat welding, adhesives, etc. The attachment can be done by any desired method as desired. Mechanical fixing together the buckle and the strap using a quick fix glue is possible. But, the preferred method was found to be by sonic bonding.

The other end of strap 10 is loose, that is not permanently attached to the buckle 1. In order to fasten together the two ends of strap 10, the loose end 12 of strap 10 is threaded first through the hole 6 between end leg 4 and bridging leg 5, and then through the hole 6 between bridging leg 5 and end leg 4. Advantageously, the bridging leg 5 has a substantially right angle, i.e. rectangular in cross section,so that the strap has at least two right angle bends when threaded. Also, at the bottom there is another right angle bend at the bottom of end leg 4. This provides further locking action. The edges at the right angles are sharp and can be extended to be blade like in appearance to provide further locking action.

Figure 6:
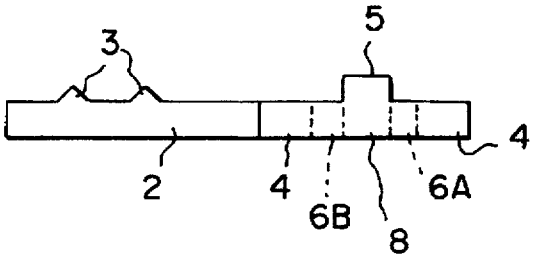
FIG. 6 is a right side elevational view depicting another illustrative embodiment.

Although in the embodiment of FIGS. 1–5, bridging leg 5 extends over hole 6 and above the plane of the frame comprising the end legs 4,4 and side legs 7,7, in another embodiment shown in FIG. 6, bridging leg 5 also extends into the hole 6 as one piece or as a second piece. In this manner, another right angle is provided by the extended part 8 at the bottom to the threaded end 12 of strap 10. Advantageously, the extended part 8 may be unitary with bridging leg 5 and the entire unit molded as a unitary structure.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A buckle consisting of a unitary structure made of a plastic resin and consisting of a substantially planar frame comprising a pair of substantially parallel end legs, and a pair of substantially parallel side legs permanently connected to said pair of end legs with a hole defined thereby; and at least one bridging leg permanently connected to each of said pair of side legs and disposed parallel to said pair of end legs with an opening between said bridging leg and said end legs, respectively;

wherein one of said pair of end legs is extended to permanently attach on one surface thereof a flat side surface of an end a strap and has a width dimension sufficient to hold a width of said strap;

said bridging leg has at least a portion thereof disposed over said planar frame and between said end legs so that an opening is defined between said bridging leg and each of said pair of end legs, respectively, said opening being of a width dimension and a thickness dimension to thread another end of said strap therethrough;

said bridging leg having a cross section of rectangular shape with right angles of said rectangular shape being sharply defined; and at least one of said end legs has a right angle at a location where an opening is defined, whereby said other end of said strap is held securely by said right angles of said bridging leg and said one end leg.

2. The buckle of claim 1, wherein said one surface of said extended end portion of said end leg has a roughened surface.

3. The buckle of claim 1, wherein said bridging leg has a portion thereof within the plane of said frame.

4. The buckle of claim 1, wherein a surface of said extended end portion of said end leg has at least one protrusion thereon.

5. The buckle of claim 4, wherein a strap end is permanently attached by sonic bonding to said extended end portion of said end leg.

6. The buckle of claim 4, wherein a strap is permanently attached by an adhesive.

7. A strapping system comprising a flat non-metallic strap having two ends; and a unitary buckle structure made of a plastic resin and consisting of a planar frame consisting of a pair of parallel end legs and a pair of parallel side legs permanently connected thereto and defining a hole therebetween;

at least one bridging leg permanently connected to said pair of side legs and disposed parallel to said pair of end legs with an opening between said bridging leg and said pair of end legs, respectively; wherein said bridging leg has a rectangular cross section with at least a part thereof being disposed above said planar frame;

one of said pair of end legs being extended to a suitable dimension so as to permanently hold on one surface thereof a flat side surface of one end of said non-metallic strap; and wherein another end of said non-metallic strap is threaded through one opening between said bridging leg and said extended portion of said one end leg, then above said bridging leg, then through another opening between said bridging leg and another end leg so that said non-metallic strap is securely held by said buckle around an object being held by said non-metallic strap.

8. The system of claim 7, wherein said bridging leg has a portion thereof disposed within the plane of said planar frame.

9. The system of claim 7, wherein said other end leg of said pair of end legs has a right angle adjacent said opening, and said bridging leg provides two right angle at the rectangular cross section so that said non-metallic strap is bent by at least three right angles when threaded through said buckle.

10. The system of claim 7, wherein said one surface of said extended portion of said one end leg has a roughened surface.

11. The system of claim 7, wherein said one surface of said extended end leg has at least one protrusion thereon.

12. The system of claim 7, wherein said one end of said non-metallic strap is attached to said one surface of said extended end portion by an adhesive.

13. The system of claim 7, wherein said one end of said non-metallic strap is attached to said one surface of said extended end portion by use of heat.

14. The system of claim 7, wherein said one end of said non-metallic strap is attached to said one surface of said extended end portion by use of sonic bonding.

* * * * *